US005301625A

United States Patent [19]

Mo

[11] Patent Number: 5,301,625

[45] Date of Patent: Apr. 12, 1994

[54] MARINE CONSTRUCTION

[75] Inventor: Olav Mo, Kristiansand, Norway

[73] Assignee: Offshore Concrete A/S, Kristiansand, Norway

[21] Appl. No.: 25,341

[22] Filed: Mar. 3, 1993

Related U.S. Application Data

[62] Division of Ser. No. 801,934, Dec. 3, 1991, Pat. No. 5,201,275.

[30] Foreign Application Priority Data

Dec. 4, 1990 [NO] Norway ..... 905239
Nov. 6, 1991 [NO] Norway ..... 914343

[51] Int. Cl.[5] ..... B63B 5/00
[52] U.S. Cl. ..... 114/65 A; 114/259
[58] Field of Search ..... 114/65 A, 258, 259, 114/260, 261, 262, 263, 45

[56] References Cited

U.S. PATENT DOCUMENTS 1,313,529 8/1919 Durham .
1,513,591 10/1924 Dorr et al. ..... 114/261
1,663,346 3/1928 Matthiessen et al. ..... 114/258
2,344,223 3/1944 Upson et al. ..... 114/65 A
3,537,268 11/1970 Georgii .
3,630,161 12/1971 Georgii .
3,686,886 8/1972 Georgii .
3,977,350 8/1976 Finsterwalder et al. ..... 114/74
3,988,995 11/1976 Finsterwalder ..... 114/74

FOREIGN PATENT DOCUMENTS 16453166 4/1966 Norway .

*Primary Examiner*—Jesus D. Sotelo
*Attorney, Agent, or Firm*—Cushman, Darby & Cushman

[57] ABSTRACT

A concrete vessel is provided with a loading and unloading system, in which the vessel has an inner hull skin which is generally cylindrically curved. An outer hull skin is provided, which is transversally spaced from, and peripherally encloses the inner hull skin. The outer hull skin is planar on an upper side, so as to form a deck. A barge dock or hanger is located between the deck and the inner hull skin. A gate is provided in the outer hull skin between the deck and the inner hull skin for floating a barge to and from the dock or hanger.

4 Claims, 9 Drawing Sheets

Fig. 11a.
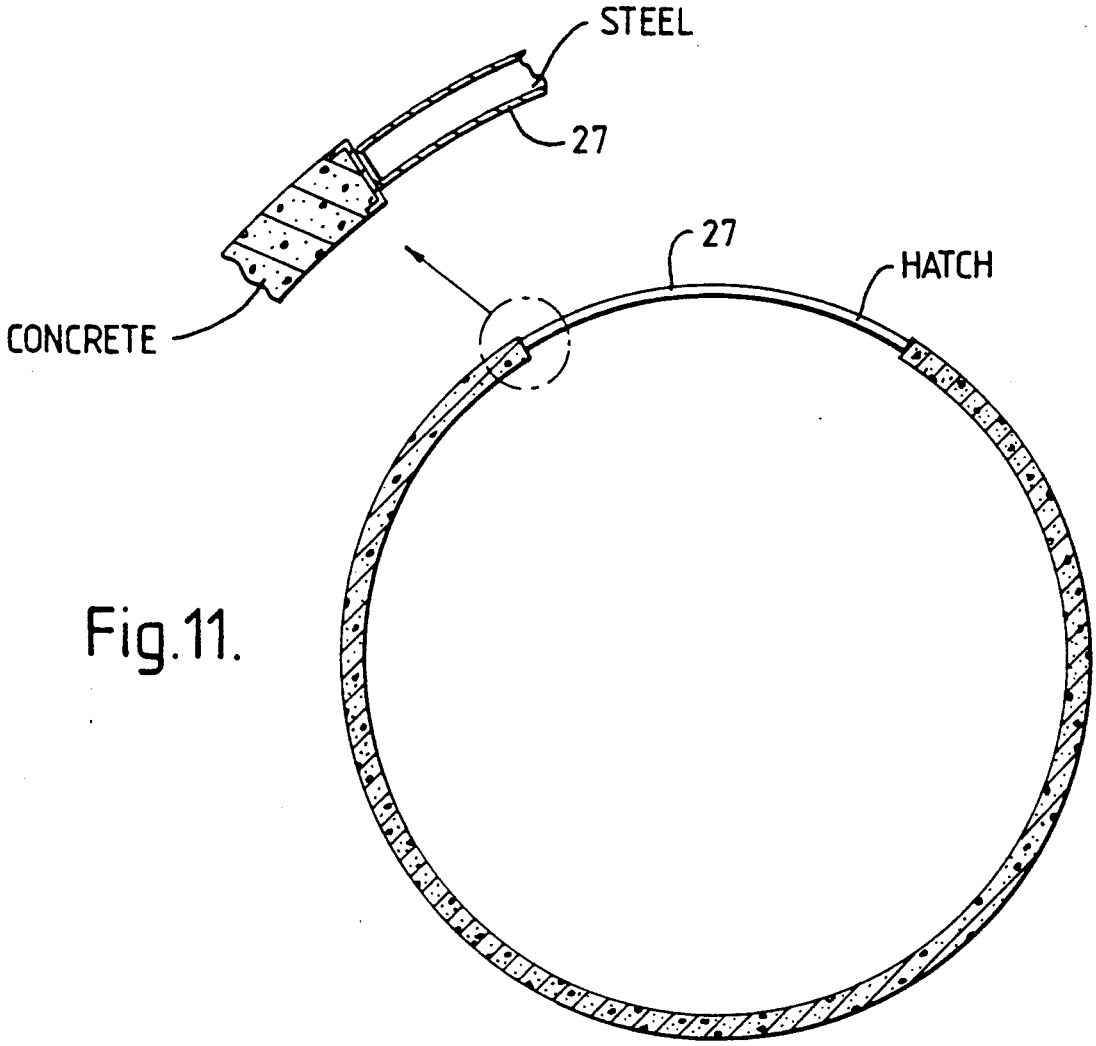
Fig. 11.
Fig. 11b.
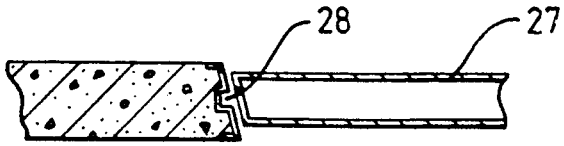

MARINE CONSTRUCTION

This application is a division of application Ser. No. 07/801,934, filed Dec. 3, 1991, U.S. Pat. No. 5,201,275.

BACKGROUND OF THE INVENTION

This invention relates to a marine construction in the forms of a concrete vessel hull. A hull of this type can among other things be used for transport, storage, floating docks, submarines and aircraft carriers.

A concrete vessel hull in itself is not a new concept. There are a number of proposals for use, but very few of them have been carried out in practice.

SUMMARY OF THE INVENTION

The marine construction of the present invention provides an inner skin having one or more circular cylindrical shells and an outer skin which has a circular cylindrical shell outside the inner skin. The outer skin can be formed as a deck above the hull which has bulkheads extending across-the entire cross section of the hull and longitudinal bulkheads between the inner and outer skins.

Further, the marine construction comprises a hull for a tanker of concrete, the hull comprising at least two substantially circular cylinders, and at least two cylinders of substantially triangular cross-section, the circular cylinders having a plurality of substantially dome-shaped bulkheads.

BRIEF DESCRIPTION OF THE DRAWINGS

Preferred embodiments of the marine construction of the present invention are described hereinbelow, with reference to the attached drawings, wherein:

FIGS. 11, 11*a* and 11*b* show an example of a hatch.

DETAILED DESCRIPTION

Figure 1:
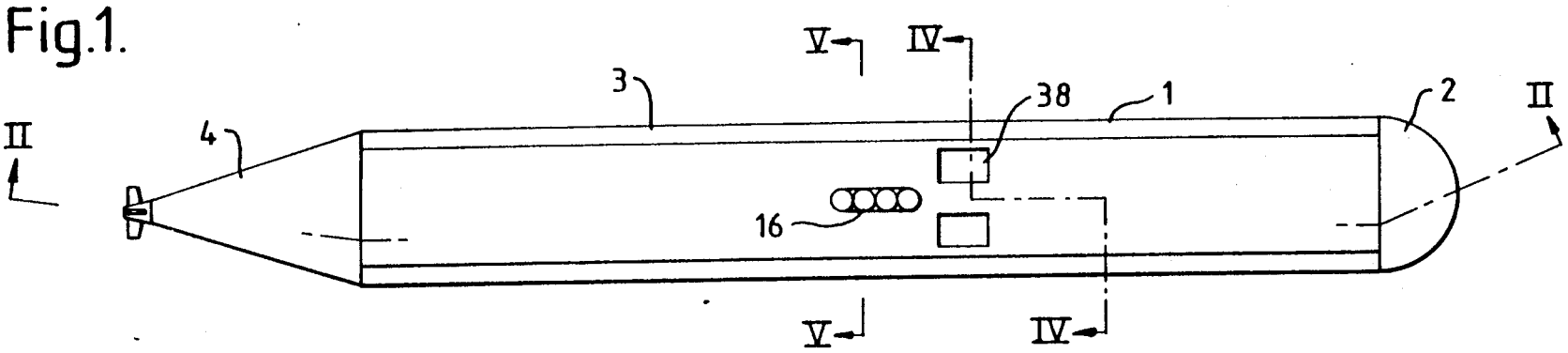
FIG. 1 is a concrete hull with an upper deck seen from above, illustrating a basic version of the invention.
Figure 2:
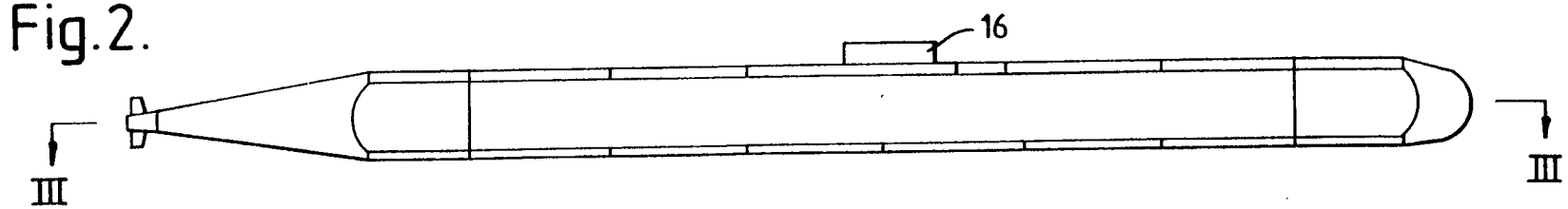
FIG. 2 is a longitudinal vertical section on line II—II of FIG. 1.
Figure 3:
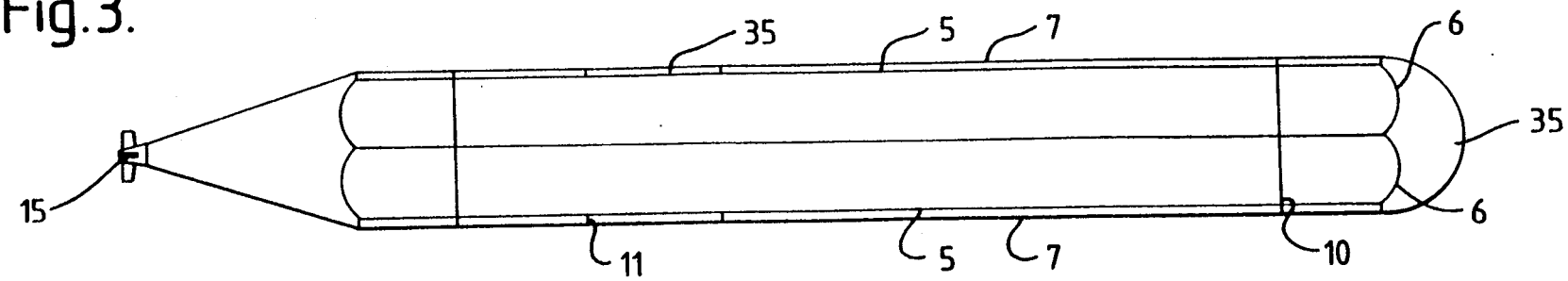
FIG. 3 is a longitudinal horizontal section on line III—III of FIG. 2.

According to the basic version as illustrated in FIGS. 1–5, the construction 1 is a submarine with a displacement of approximately 300,000 tons. The hull includes a bow section 2, a main or center part 3, and a stern part 4. The main part 3 is built around two laterally adjacent cylinders 5 which together constitute the inner skin of the hull. The cylinders 5 each have a dome 6 at each end. The cylinders 5 are protected by the external cylinders 7 and a deck 8 which constitute the outer skin. The respective internal and external cylinders are connected to one another by means of longitudinal ribs 9. The hull has internal bulkheads 10 and ring girders 11 between the inner and outer shells (i.e. the inner and outer skin). There are decks 12 and walls 13 in the internal cylinders 5. The deck 8 rests on longitudinal walls 14.

The vessel is equipped with a rudder and a propeller. These are located at the stern in a steel component 15 connected to the stern concrete part 4. The submarine is supplied with a tower 16.

Under normal circumstances, only the inner skin and tower will sustain the water pressure in submerged position. Thus, the volumes outside the internal cylinders and tower will be filled with water.

Figure 6:
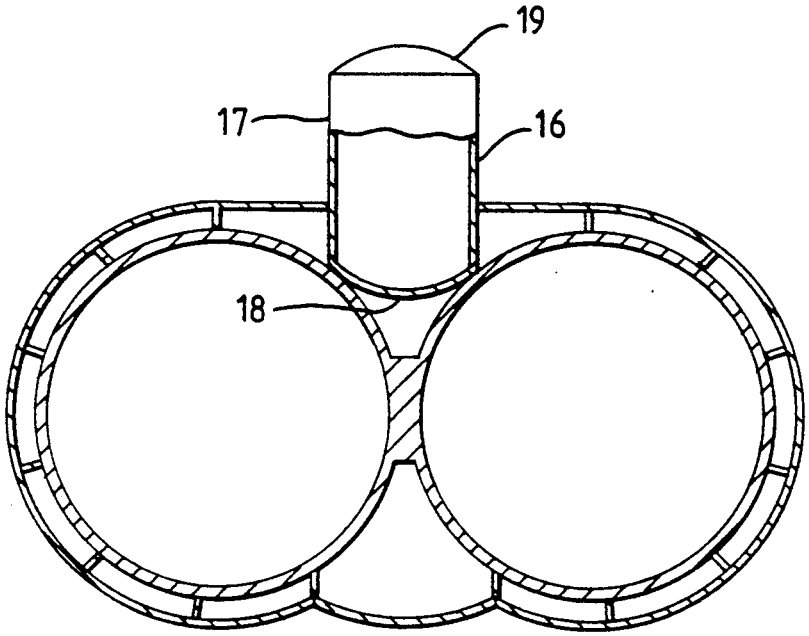
FIG. 6 is a first alternative of the basic version, seen in cross-section.

The first alternative departs from the basic version only in that the deck 8 has been omitted. The section illustrated in FIG. 6 is taken through the tower 16. The tower includes vertical concrete cylinders 17. At the foot of each cylinder 17 there is a dome 18, and at the top of each cylinder 17 there is a dome 19 made of steel. The domes 19 can be hinged in such a way that the tower can be fully opened at the top when the vessel is in a surfaced position (see FIG. 12).

Figure 4:
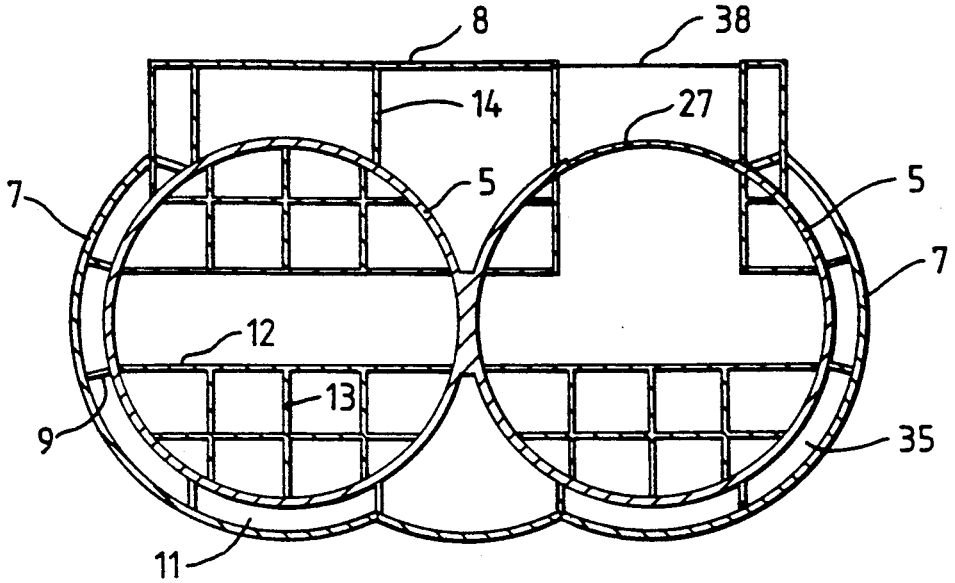
FIG. 4 is the cross-section on line IV—IV of FIG. 1.
Figure 5:
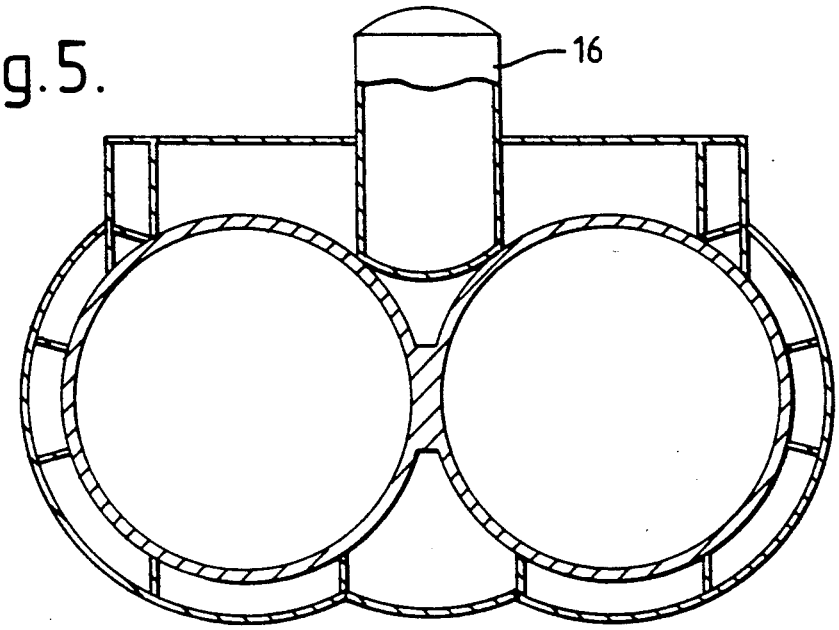
FIG. 5 is the cross-section on line V—V of FIG. 1.
Figure 7:
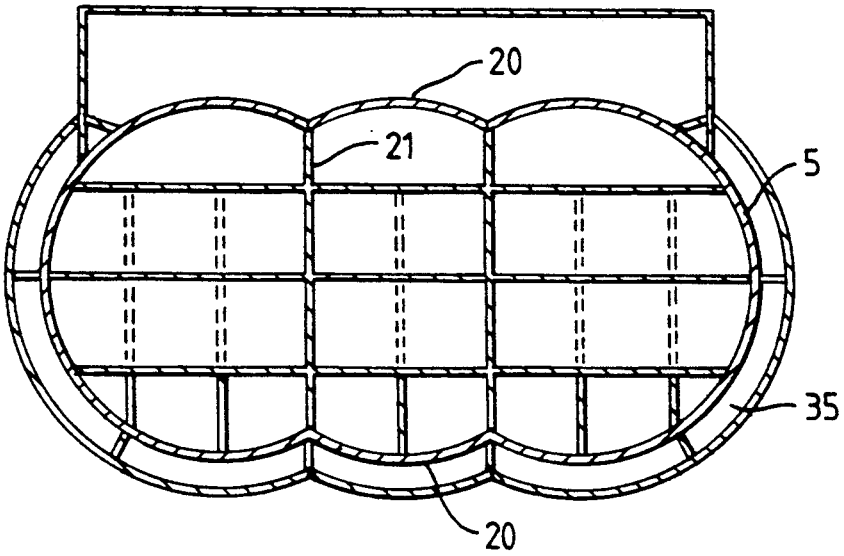
FIG. 7 is a second alternative of the basic version, seen in cross-section.

FIG. 7 shows a second alternative in cross-section and corresponds to FIG. 4. The difference between the basic version and the second alternative is that, in the second alternative, the longitudinal cylinders 5 are not fully circular cylindrical. The otherwise most medial parts thereof are omitted and a section of a third cylinder 20 has been installed. The outer hull of the basic version and that of the second alternative are similar. However, the second alternative has an interior arrangement superior to that of the basic version. The walls 21 are static supporting walls. As can be seen from the illustration, the internal cylinders 5 are circular cylindrical to counteract the water pressure.

Figure 8:
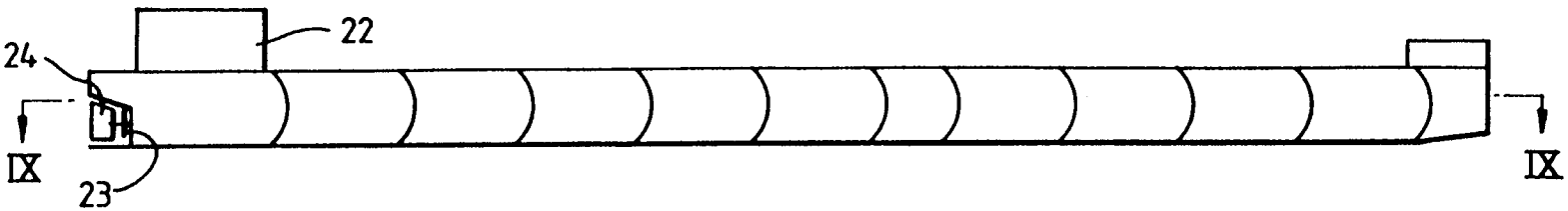
FIG. 8 is a longitudinal vertical section of a third alternative of the basic version.
Figure 9:
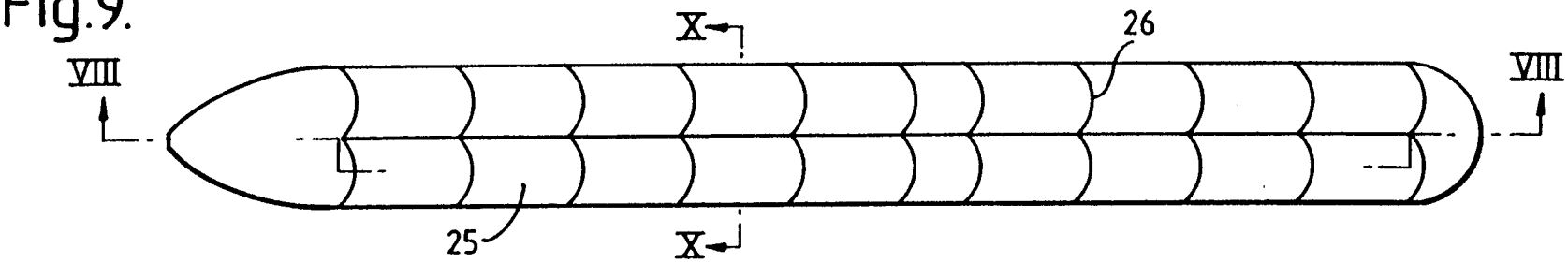
FIG. 9 is a longitudinal horizontal section of the third alternative of the basic version.
Figure 10:
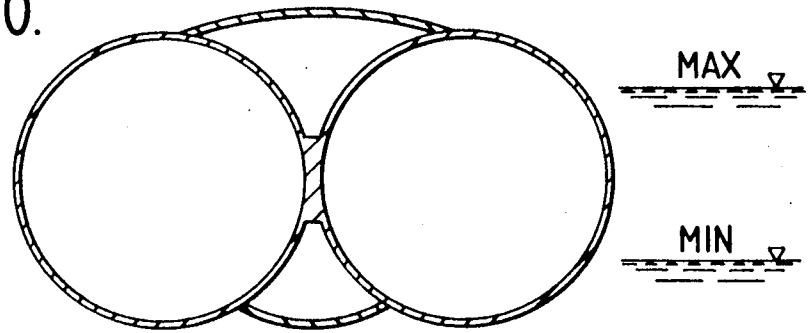
FIG. 10 is a cross-section of the third alternative of the basic version.

FIGS. 8–10 illustrate a third alternative. This is a so-called VLCC, i.e. a large tanker. The vessel has only one skin, and an equivalent of the external cylinder of the first-described embodiment is therefore not present. The vessel is built around a pressure-resistant cylinder. Instead of the tower of the first-described embodiment, there is a conventional superstructure 22. The propeller 23 and rudder 24 are also conventional, but have been adapted to the new hull. The vessel has no walls or deck in the tanks 25. The bulkheads 26 are formed like domes. However, the third alternative is not suitable for submarine constructions.

When large objects such as aircraft are to be transported from hangar to deck and vice versa, the vessel needs to be equipped with specially designed hatches. The dimensions of such a hatch could be $10 \times 15$ m, and it must be fluid-tight and pressure resistant. A proposal is illustrated in FIGS. 11, 11*a* and 11*b*. FIG. 11*b* is a longitudinal section. The hatch cover 27 (when the hatch is closed) is statically part of the pressure-resistant hull. The hatch cover 27 may be made of concrete and built in the same way as the cylinder skin. The hatch cover 27 in FIGS.-11, 11*a* and 11*b* is made of steel. In the circumferential direction, the hatch cover will be subject compressive forces corresponding to the cylinder. In the longitudinal direction, however, a small recess 28 has been installed so that the hatch cover will not be subject to the cylinder forces this way. A seal needs to be installed.

The outer hatch cover 38 (FIG. 4) can have a mechanically weaker and conventional design.

In order to open the hatch, the hatch cover 27 is lifted and moved aside, preferably in a longitudinal direction. Smaller hatches can be opened as usual, when hinged.

The tower functions are the same as for ordinary submarine towers. A few new functions may be added.

Figure 12:
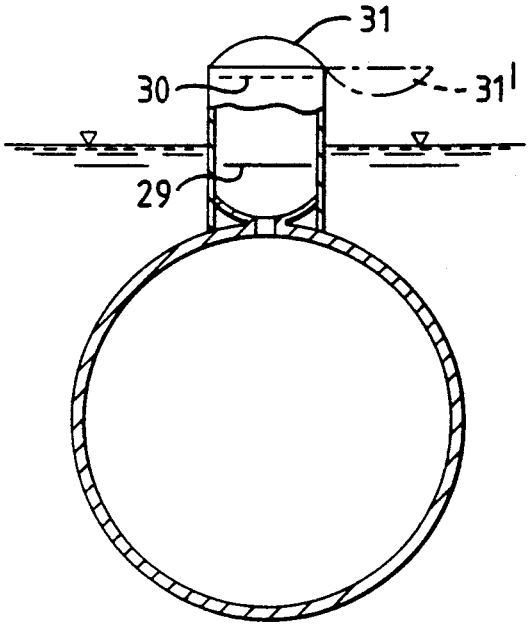
FIG. 12 is a vertical section of a tower cylinder.

FIG. 12 shows a tower cylinder with additional tower functions. The cylinder is equipped with an elevator floor, which is in a low position 29 as illustrated.

The elevator floor 29 may also have an upper position 30. The upper dome 31 is made of steel. It is hinged and can be tilted, which is indicated at 31'.

Helicopters, anti-aircraft guns or electronics of various types can be located on the elevator floor.

When the submarine is submerged, the elevator floor 29 will be in a low position, as illustrated in FIG. 12. When the submarine tower is above surface, the upper dome 31 can be removed and the elevator floor lifted to its upper position 30. Thus, the equipment is operative even before the hull is above water surface.

Figure 13:
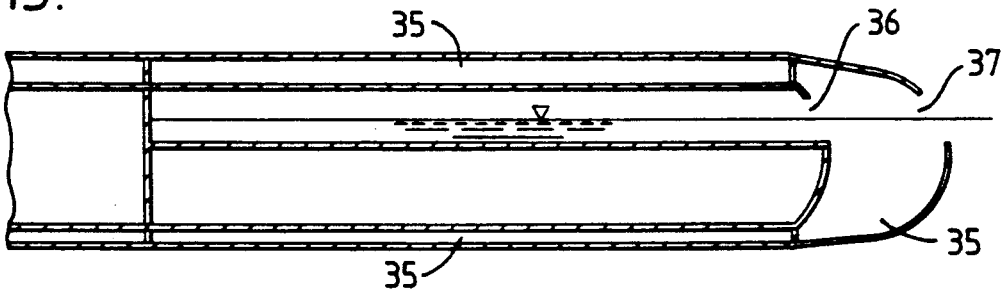
FIG. 13 shows an example of a dock.
Figure 14:
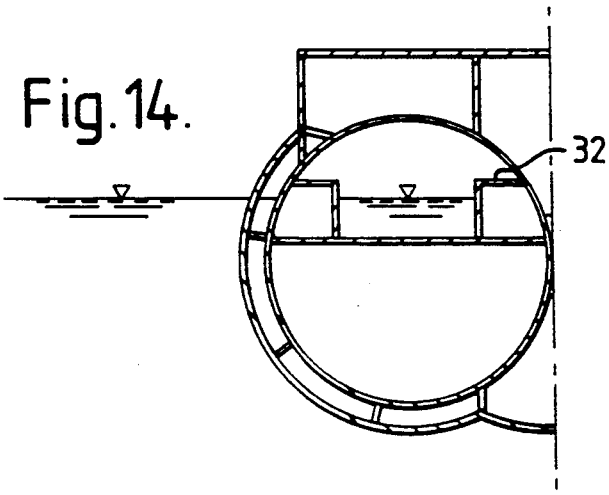
FIG. 14 is a cross section of the dock of FIG. 13.

The concrete hull can also be equipped with a dock, as illustrated in FIGS. 13 and 14. In the example, the concrete vessel is in surfaced position. Both the inner 36 and outer hatches 37 are open. The hatches are located in the bow of the concrete vessel. The hatches may also be located at the side. The dock is equipped with a quay 32. FIGS. 13 and 14 presuppose a concrete hull similar to the basic version.

The production of the hull is carried out by means of slipform concrete casting in vertical position, preferably with the bow pointing down.

The production process can be summed up as follows:

1. The bow section is cast in vertical position on land or in a building dock.

2. The bow section is launched.

3. The bow section is towed to a deep-water site and anchored to preinstalled mooring.

4. The hull is slipformed up to the first bulkhead. The structure is ballasted in order to obtain necessary trim and desired freeboard.

5. The first bulkhead is cast by conventional methods.

Figure 15:
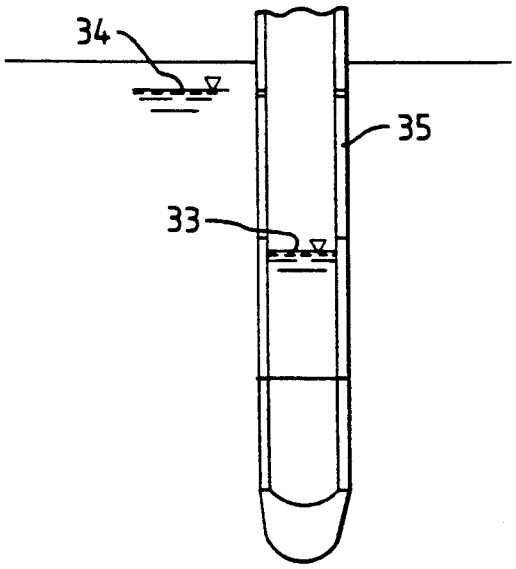
FIG. 15 and 16 illustrate a preferred production method for making the concrete hull.

6. The rest of the center section is cast. The vertical sections are slipformed, while the horizontal sections are cast by conventional methods (see FIG. 15). The internal cylinders must sustain most of the water pressure. The numeral 33 indicates water level. The area between the internal and external cylinders can be used for trimming. The numeral 34 indicates water level at this intermediate volume.

7. The stern part is cast by conventional methods. In some cases, the body may be cast by means of slipforms, possibly using conical slipforms.

Figure 16:
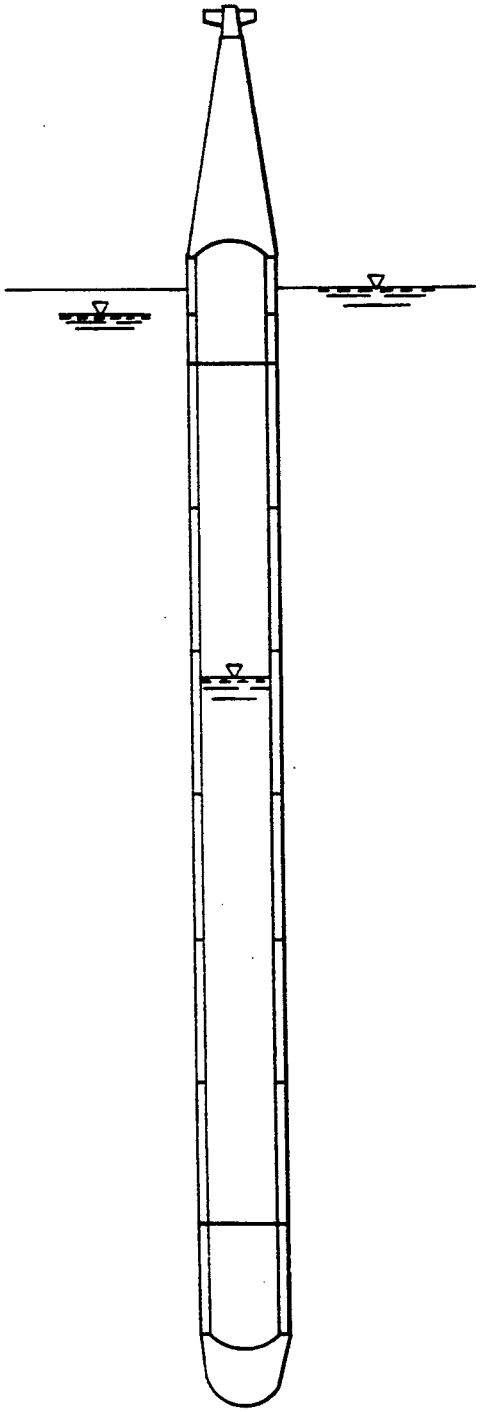

8. The stern steel section, propeller and rudder are mounted by means of a floating crane, see FIG. 16.

9. The hull is trimmed to floating horizontal position.

10. The hull is towed to an outfitting quay.

11. The remaining concrete components are cast. The sail cylinders may be slipformed while the rest is cast by conventional methods.

Both the design and the production process of this structure are similar to the so-called Condeep® platforms and the production process for manufacturing them. In order to understand the description and drawings of this document, some knowledge of the Condeep® concept is required.

The hatch as illustrated in FIG. 11, creates certain problems as it must be waterproof and pressure-resistant already in the slipform process. The simplest method of securing the hatches, is to install the coamings thereof during the slipform process and continue slipforming the locations where hatches are to be installed. The superfluous concrete inside the coamings can be removed when the vessel is lifted to a horizontal position.

An advanced method would be to cast the hatch cover during the slipform operation. In this case the hatch cover must be made of concrete.

It is also possible to install the coaming underneath the slipform and install a steel hatch while the main slipform operation takes place.

The intermediate volume 35 between the internal cylinders 5 and external cylinders 7 requires a detailed description. In a double skin vessel the external cylinders 7 protect the internal cylinders 5. It may be of great importance how the intermediate volume 35 is made and what it is filled with.

The intermediate volume 35 can communicate with sea water. In this case the external cylinder 7 will only exercise passive protection of the concrete hull, and be filled with water or air depending on draught. The intermediate volume 35 can also be partly and permanently filled with air, for example by inserting plastic cones filled with air in the intermediate volume. Explosions on the outside will reduce the thrust on the internal cylinder 5. The intermediate volume 35 can be filled with substances intended to protect the internal cylinder 35. Examples of such substances are leca or light concrete.

Inner and outer skins with an intermediate volume used for various purposes are well-known concepts in the building of submarines.

The concrete construction itself is made of superior quality ordinary concrete or light concrete. The central constructions are normally prestressed in both directions. Wall thickness is normally 30 to 50 cm.

In the above examples there are two main cylinders. One or three cylinders may also be used. Any number above 3 is rare except in cases of cut cylinders as illustrated in FIG. 7.

Instead of circular shells, shells with varying radius of curvature may be used. In FIG. 10, the circular shell could be 25 m diameter, circumscribed by a 25 m×25 m square. If the radius of curvature in the "corners" is to be reduced, and the radius of curvature at the centers of the sides to be increased, the shell will be something in between a square and a circle in cross section. This type of shell has good carrying capacity if the end slabs are rigid and the distance between them is not too long. In this case, the bulkheads 26 will function as the end slabs. If the shell is not circular, the end slabs cannot be shaped as domes, and will have to be planar or have a varying radii of curvature.

The intermediate volume 35 can be filled with very light materials, such as foamed plastics (e.g., polystyrene).

The active, load-carrying skin is usually the inner skin 5. The outer skin 7 can also be active. In this case, the inner skin becomes a spare skin. It is an advantage if the outer skin or preferably both have valves. The intermediate volume 35 should be equipped with pumps. This enables freedom of how to carry out any operation.

It may be relevant to use fibre-filled concrete instead of conventional reinforced concrete. It is also possible to use a combination fiber-filled and conventionally reinforced concrete. With fibre-filled concrete, it may be possible to reduce the thickness of the cross-section considerably.

In the above description, it is assumed that the entire hull is cast in one process. However, it is possible to split the production process into several sections. The initial section does not have to be the bow section. The bottom section can be a bulkhead 10, 26. A small section is slipformed and launched. Then, the slipform process proceeds as usual. The process is completed by providing a wall, which at least partly has to be watertight, and trimming of the section to a horizontal position. When all the sections are completed, they are floated and arranged in proper mutual positions. A small coffer dam is installed on top of the joint, and the sections are cast together. This production method is independent of water depth. The hull may be made to desired length.

If the hull only includes one main cylinder 5, 7, it is possible to operate with a varying diameter. With a reduced diameter towards the ends, the hull will have a hydrodynamically improved design.

The sequence in the production process can be varied. It is for instance, possible to proceed past one or several bulkheads and cast these at a later stage.

The structures shown in FIGS. 1–7 are usually intended for transport, bases, equipment storage and storage of aircraft or helicopters.

Figure 17:
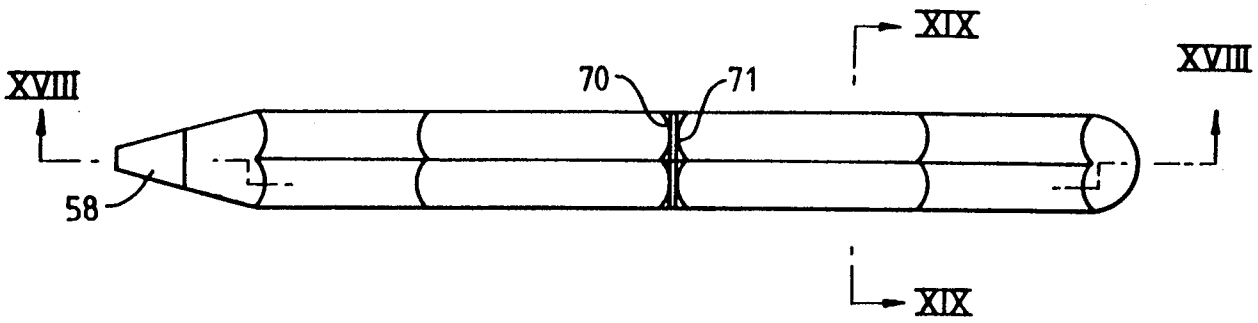
FIG. 17 is a longitudinal horizontal section of a fourth alternative of the basic version.
Figure 18:
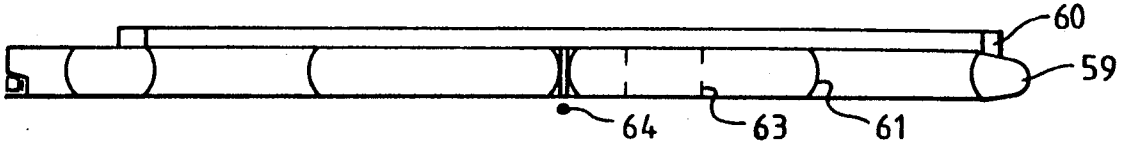
FIG. 18 is a longitudinal vertical section of the fourth alternative of the basic version.
Figure 19:
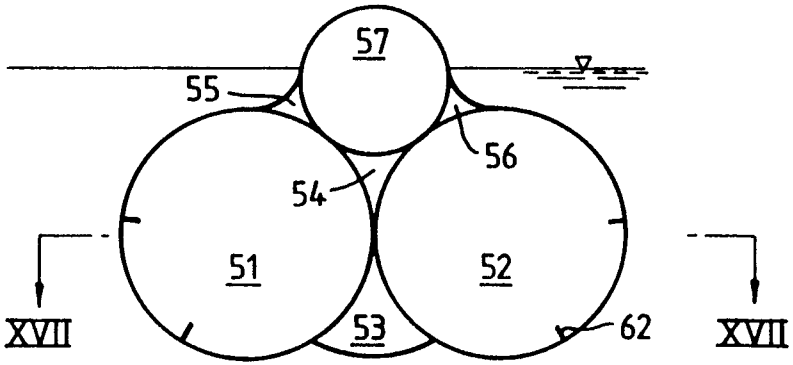
FIG. 19 is a cross-section of the fourth alternative of the basic version.

FIGS. 17–19 represent the fourth alternative. This is a tanker principally intended for transport of fresh water, but also for transport of other substances such as oil. In cross-section the vessel has two main tanks 51, 52. There are four smaller, triangular tanks 53, 54, 55, 56, and a float tank 57. If the substance to be transported is fresh water, the main tanks 51, 52 will be filled with fresh water when the vessel is loaded. The triangular tanks 53–56 may also carry fresh water. When loading and unloading, care has to be taken in order not to impart too much stress in the walls. In particular, high tension should be avoided. The float tank 57 is filled with air. The engine room 58 as illustrated in FIG. 17 is also filled with air. All other tanks may be filled with water. In this condition, the outside water level may be halfway on the float tank, as illustrated in FIG. 19.

The tank 57 provides necessary buoyancy and contains trim tanks, fluid tanks, accommodation, bridge, etc.

The main tanks 51, 52 are rounded at the bow 59. The float tank 57 which is located at water surface level, is sharp at the bow 60.

The main tanks 51, 52 as well as the float tank 57 are approximately circular in cross-section. The bulkheads 61 may be made as domes.

The main tanks 51, 52 have longitudinal ribs 62 and transverse ribs 63.

During production, the hull is divided at the point marked 64. Both sections are initiated in dock with a level slab 70, 71. In such an instance, required depth is reduced for the building dock.

FIG. 19 shows a loaded and semisubmerged vessel. The fourth alternative is also suitable for a submerged position, if required. When the vessel is unloaded, the draught is only 7 meters.

Figure 20:
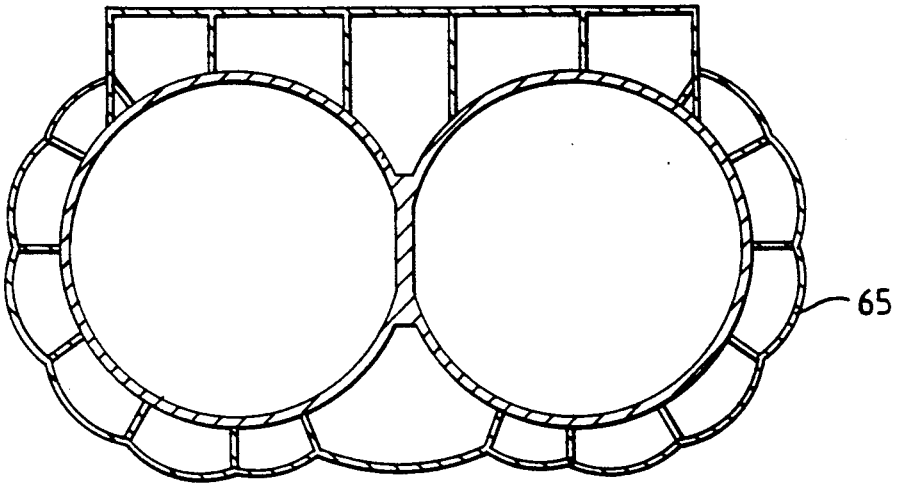
FIG. 20 is a cross-section of a fifth alternative of the basic version.

FIG. 20 shows a fifth alternative of the basic version. The outer skin is designed as a multiple-arch construction 65. Such a construction can have a thinner outer skin and simplified reinforcement.

Figure 21:
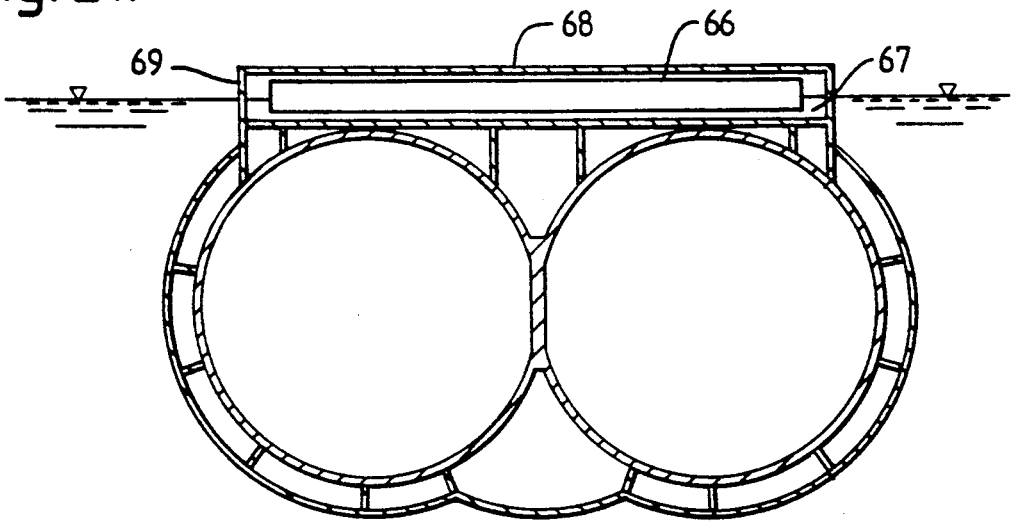
FIG. 21 is a landing arrangement according to the invention.

FIG. 21 shows a practical solution to the problem which occurs when heavy equipment, such as tanks, are to be loaded or unloaded at places where there are no ports. According to the invention, the vessel brings a "barge" 66 into a "hanger" 67 located right underneath the deck 68. The barge is floated through a gate 69 and used for loading and unloading equipment to/from the deck 68. The hangar 67 and the barge 66 are filled with water when the vessel is submerged. Thus, there is no statical stress due to water pressure. Any outboard motors are removed from the barge when the barge is in the hangar and the vessel is in a submerged position.

It is particularly important to realize the possibility of combining various alternatives; details from one alternative can be combined with those of another alternative.

The measurements and indications are to be regarded as approximate information. A circular cylindrical shell does not necessary have to be accurately circular in order to achieve satisfactory operation.

Approximate indications make the invention more comprehensible. However, they shall not be used for the purpose of evading accomplished patent rights.

All illustrated measurements are given in meters.

I claim:

1. A self-loadable and unloadable concrete-hulled submarine vessel system, comprising:

a concrete-hulled submarine including:

an inner skin made of concrete and providing a watertight, pressure-resistant hull;

an outer skin made of concrete spacedly surrounding said inner skin and thereby peripherally substantially enclosing said watertight, pressure-resistant hull and providing an enclosed space between said inner and outer skins, said hull being arranged to contain equipment which is to be transported; said outer skin having an upper side which in use is usually disposed facing upwardly, above said inner skin; said upper side having a planar region forming a deck;

bulkhead and girder structure supporting said outer skin from said inner skin;

at least one barge ingress and egress aperture formed through said outer skin;

said skins, aperture and bulkhead and girder structure being arranged to provide a stowing hanger for at least one barge between said inner skin and said outer skin;

at least part of said enclosed space, including at least part of said barge stowing hanger being arranged to flood with water due to submerging of said submarine, and to empty of water due to surfacing of said submarine;

a barge which is arranged to be floated from externally of said submarine, into said stowing hanger, and from said stowing hanger to externally of said submarine, when said submarine is in a surfaced state, whereby said barge is arranged to be transported by said submarine;

said barge while in said stowing location being arranged to at least partially flood with water as said barge stowing hanger at least partially floods with water due to submerging of said submarine, and to empty of water as said barge stowing hanger empties of water due to surfacing of said submarine; and said barge while floating externally of said submarine when said submarine is in said surfaced state, being arranged to load equipment onto said deck for transportation by said submarine, and to unload equipment which has been transported by said submarine, from said deck onto said barge.

2. The self-loadable and unloadable concrete-hulled submarine vessel system of claim 1, further including:

a barge propulsion motor demountably mounted to said barge, for demounting in preparation for submerging of said submarine while containing said barge in said stowing hanger.

3. The self-loadable and unloadable concrete-hulled submarine vessel system of claim 1, wherein:

said bulkhead and girder structure also is made of concrete.

4. The self-loadable and unloadable concrete-hulled submarine vessel system of claim 1, wherein:

said stowing hanger is located over said watertight pressure-resistant hull, under said deck.

* * * * *